US005081825A

United States Patent [19]

Mrozinski

[11] Patent Number: 5,081,825

[45] Date of Patent: Jan. 21, 1992

[54] ENVELOPE FLAP UNFOLDER AND ENCLOSURE INSERTER WITH JAM-CLEARING ACCESS

[75] Inventor: Curtis Mrozinski, Newtown, Conn.

[73] Assignee: Pitney Bowes Inc., Stamford, Conn.

[21] Appl. No.: 636,536

[22] Filed: Dec. 31, 1990

[51] Int. Cl.[5] ..... B65B 59/04

[52] U.S. Cl. ..... 53/569; 53/284.3

[58] Field of Search ..... 53/569, 460, 381.7, 53/381.5, 387.1, 284.3; 493/245, 477, 475, 476

[56] References Cited

U.S. PATENT DOCUMENTS

| | | | |
|---|---|---|---|
| 4,169,341 | 10/1979 | Roetter et al. | 53/569 X |
| 4,570,923 | 2/1986 | Hooper et al. | 271/275 |
| 4,619,101 | 10/1986 | Havey, Jr. et al. | 53/117 |
| 4,775,140 | 10/1988 | Foster | 271/121 |
| 4,903,461 | 2/1990 | Dimur | 53/284.3 X |
| 4,924,652 | 5/1990 | Krasuski et al. | 53/284.3 X |

*Primary Examiner*—James F. Coan

*Attorney, Agent, or Firm*—Charles R. Malandra, Jr.; David E. Pitchenik; Melvin J. Scolnick

[57] ABSTRACT

Apparatus is disclosed for flapping envelopes and inserting enclosures into the flapped envelopes. The apparatus is constructed so that parts thereof may be easily moved to substantially fully expose the enclosure feed path, as well as the envelope flap unfolding path and the upstream end of the location at which an envelope is held open and enclosures inserted therein, thereby facilitating removal of jammed envelopes and enclosures. The components for unfolding the envelope flap are provided as an assembly movably mounted with respect to the enclosure transporter. This allows that entire flap unfolding assembly to be moved away from an enclosure transporter, thereby providing access to the enclosure feed path and to the upstream end of a queuing station. The flap unfolding assembly includes two frames which may be pivoted apart to provide access to the flap unfolding path.

16 Claims, 8 Drawing Sheets

37
10
14
66
68
69
192
64
132
66
46
38
46
88
170
174
59
172

ENVELOPE FLAP UNFOLDER AND ENCLOSURE INSERTER WITH JAM-CLEARING ACCESS

BACKGROUND OF THE INVENTION

The invention disclosed herein relates to apparatus for inserting documents or enclosures into envelopes, and more particularly to such apparatus which unfolds the envelope flap and feeds the enclosure or enclosures into the "flapped" envelope.

The mailing process involves a number of operations including assembly and insertion of mail items into an envelope, moistening the envelope flap, sealing the envelope, weighing the envelope, applying postage, etc. Automation of such operations typically entails moving an envelope into and through a station which carries out the particular function. With respect to the document feeding operations, see, for example, U.S. Pat. Nos. 4,169,341 (Roether et al.), 4,570,923 (Hooper et al), 4,619,101 (Havey, Jr., al.), and 4,775,140 (Foster). The disclosures of those patents, which are assigned to the assignee of this application, are hereby incorporated by reference. Frequently, rollers and belt conveyors are used to move the envelope within a station while the particular mailing function is carried out. As the throughput of modern mailing apparatus increases, envelope jamming has occurred more frequently requiring more frequent operator intervention and longer overall machine down time. Where the envelope path is not easily accessible, machine down time has become even longer because of the difficulty of reaching and removing jammed envelopes.

U S. Pat. No. 4,775,140, cited above, discloses an apparatus comprising an envelope feeder and an envelope "flapper" which unfolds or "flaps" envelope flaps open so that documents may be inserted into the "flapped" envelope at a queuing station. The apparatus disclosed in that patent includes a pivoting frame assembly to provide jam-clearing access to the envelope feed path through the envelope flapper. However, this patent does not address jam-clearing access to the enclosure feed path and the upstream end of the queuing station.

OBJECTS AND SUMMARY OF THE INVENTION

It is an object of the invention disclosed herein to reduce the time necessary to remove a jammed envelope or document from automatic mailing apparatus, particularly automatic document inserter apparatus.

It is another object of the invention to provide improved access to apparatus which flaps envelopes and inserts documents into the flapped envelopes.

It is another object to increase the throughput of such apparatus by reducing the time required to clear jammed documents and/or envelopes.

It is another object of the invention to provide jam-clearing access to the document feed path of such apparatus.

It is another object of the invention to provide jam-clearing access to the envelope fed path and to the document feed path of such apparatus.

It is another object of the invention to improve apparatus which flaps envelopes and inserts documents into the flapped envelopes.

The above and other objects and advantages of the invention are achieved, in accordance with the invention, by constructing apparatus so that parts thereof may be easily moved to substantially fully expose the document feed path, as well as the envelope flap unfolding path and the upstream end of the location at which an envelope is held open and enclosures inserted therein, thereby facilitating removal of jammed envelopes and enclosures.

In accordance with the invention, means for unfolding the envelope flap are provided as an assembly movably mounted with respect to means for feeding enclosures to an envelope which has been flapped by the means for unfolding. This allows the flap unfolding means to be moved away from the enclosure feeding means, thereby providing access to the enclosure feed path.

In order to provide the flap unfolding means as an assembly, the invention provides for pivoting the entire assembly and supplying the drive for a moving surface in the assembly to a shaft about the axis of which the assembly is pivoted. That shaft then is not moved during pivoting of the assembly which simplifies coupling of a drive to that shaft. The drive is in turn transmitted from that shaft to the moving surface within the assembly.

In accordance with an aspect of the invention, the flap unfolding means is configured and mounted such that it may be pivoted apart to provide access to the flap unfolding path. Advantageously, the means transmitting the drive from the shaft referred to above is not moved, again simplifying coupling of the drive from the shaft to the moving surface.

In accordance with the invention, an envelope is moved along a flap unfolding path flap by unfolding means to an enclosure inserting location where means hold the flap-unfolded envelope open. Means move an enclosure along an enclosure feed path to the held-open envelope and insert the enclosure into the held-open envelope. In a first operating position thereof the flap unfolding means substantially blocks access to the enclosure feed path and means are provided for moving the flap unfolding means away from the first operating position thereof to permit access to the enclosure feed path.

The enclosure inserting means comprises first and second opposed surfaces defining the enclosure feed path and between which an enclosure is engaged and moved, at least one of the surfaces being movable in the direction of the enclosure feed path. The apparatus comprises a mounting structure to which the flap unfolding means and the first surface are mounted. The assembly of the mounting structure and the flap unfolding means may be referred to as the envelope flap enfolding assembly. The first surface of the enclosure inserting means is also mounted to that assembly. The apparatus also comprises a base frame to which the enclosure moving means is mounted and means movably mounting the second surface to the base frame. The mounting structure in the first operating position of the flap unfolding means positions the first and second surfaces adjacent each other, and the means for moving the flap unfolding means comprises means pivotally connecting the mounting structure to the base frame for movement of the mounting structure from the first position in which the first and second surfaces are adjacent each other to the other position in which the first surface is pivoted away from and exposing the second surface, thereby exposing the enclosure feed path.

The second surface is defined by at least one endless belt and the means for movably mounting the second surface to the base frame comprises at least one pulley mounted to a shaft, the shaft being mounted to the base frame. The first surface is defined by a smooth surface fixed to the mounting structure which has a contour conforming to the enclosure feed path which the smooth surface in part defines.

The flap unfolding means comprises means for engaging the flap of an envelope moved therepast and a movable surface which moves the envelope along the flap unfolding path past the engaging means. The mounting structure comprises a first frame to which the engaging means is mounted, a second frame to which the movable surface of the flap unfolding means is mounted and means pivotally connecting the first and second frames together for movement of the first frame from a first operating position in which the engaging means is adjacent the moving surface of the flap unfolding means and another position in which the engaging means is pivoted away from and exposing the moving surface of the flap unfolding means, and thereby the flap unfolding path.

The movable surface of the flap unfolding means comprises a first roller rotatably mounted to the second frame. The engaging means comprises a plurality of fingers each having a projection thereon. The fingers are pivotally mounted to the first frame such that the downstream edge of an envelope moving in the flap unfolding path engages the projections and pivots the fingers, the projections in the pivoted position of the fingers engaging the flap of the envelope and unfolding it as the roller continues movement of the envelope along the flap unfolding path, the roller being substantially exposed in the other position of the first frame.

The flap unfolding means comprises a second roller mounted to the first frame, the first and second rollers in the first position of the first frame forming a nip to which an envelope whose flap is to be unfolded is fed. The second roller is moved away from and exposing the first roller in the other position of the first mounting frame.

The mounting structure is mounted to the base frame by the shaft referred to above. As mentioned, that shaft is driven and rotation of that shaft is coupled to the movable surface of the flap unfolding means. In a specific embodiment, the movable surface is a roller mounted on a shaft supported by the mounting structure, and belts and pulleys couple the rotation of the shaft to the roller. The roller is mounted such that the two frames of the mounting structure may be pivoted apart without disturbing the belts.

BRIEF DESCRIPTION OF THE DRAWINGS

The invention is illustrated by way of example and not limitation in the figures of the accompanying drawings in which like references denote the same or corresponding parts, and in which.

DESCRIPTION OF THE PREFERRED EMBODIMENTS

Figure 1:
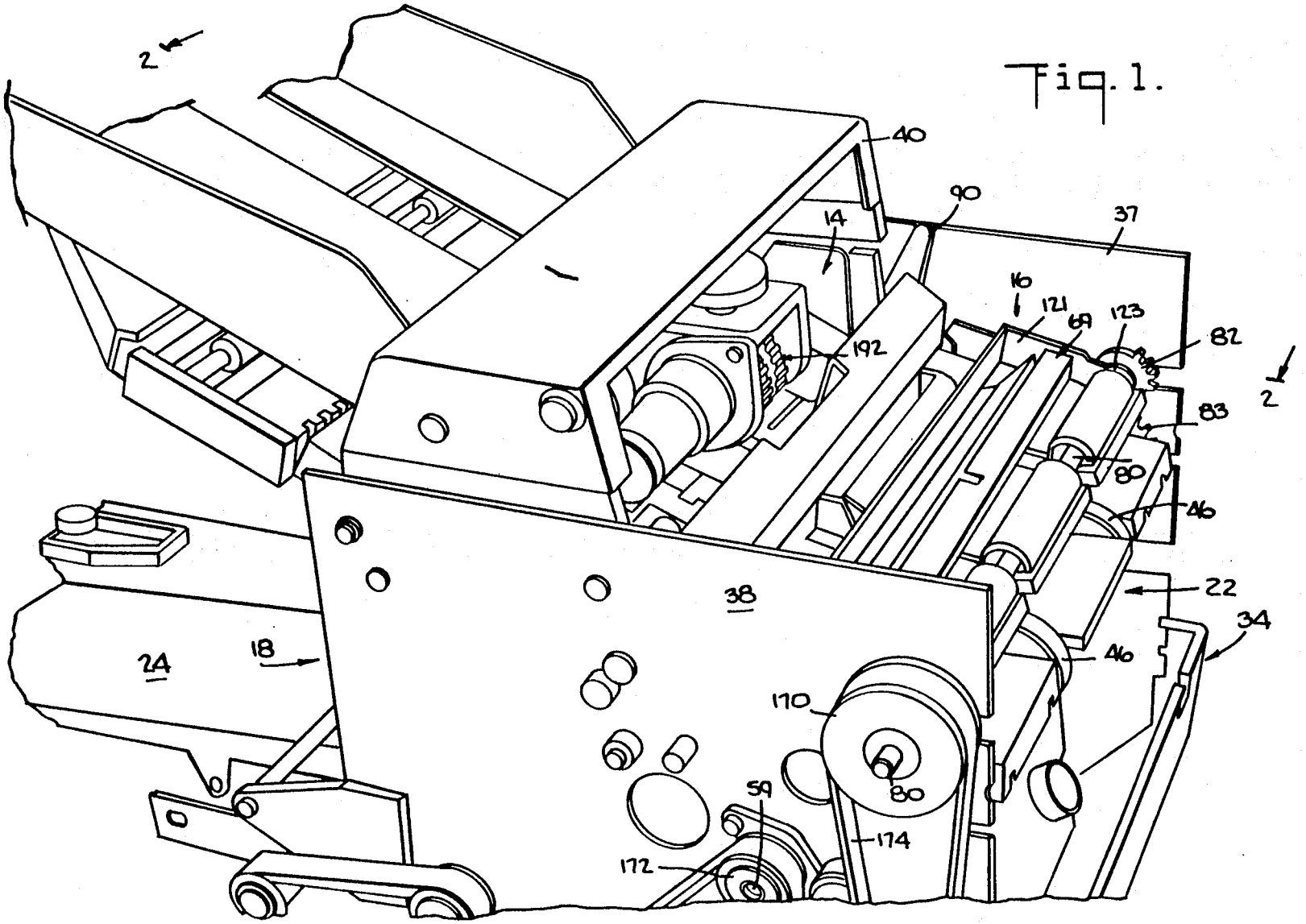
FIG. 1 is a perspective view of apparatus according to the invention for flapping envelopes and inserting documents into the flapped envelopes.
Figure 2:
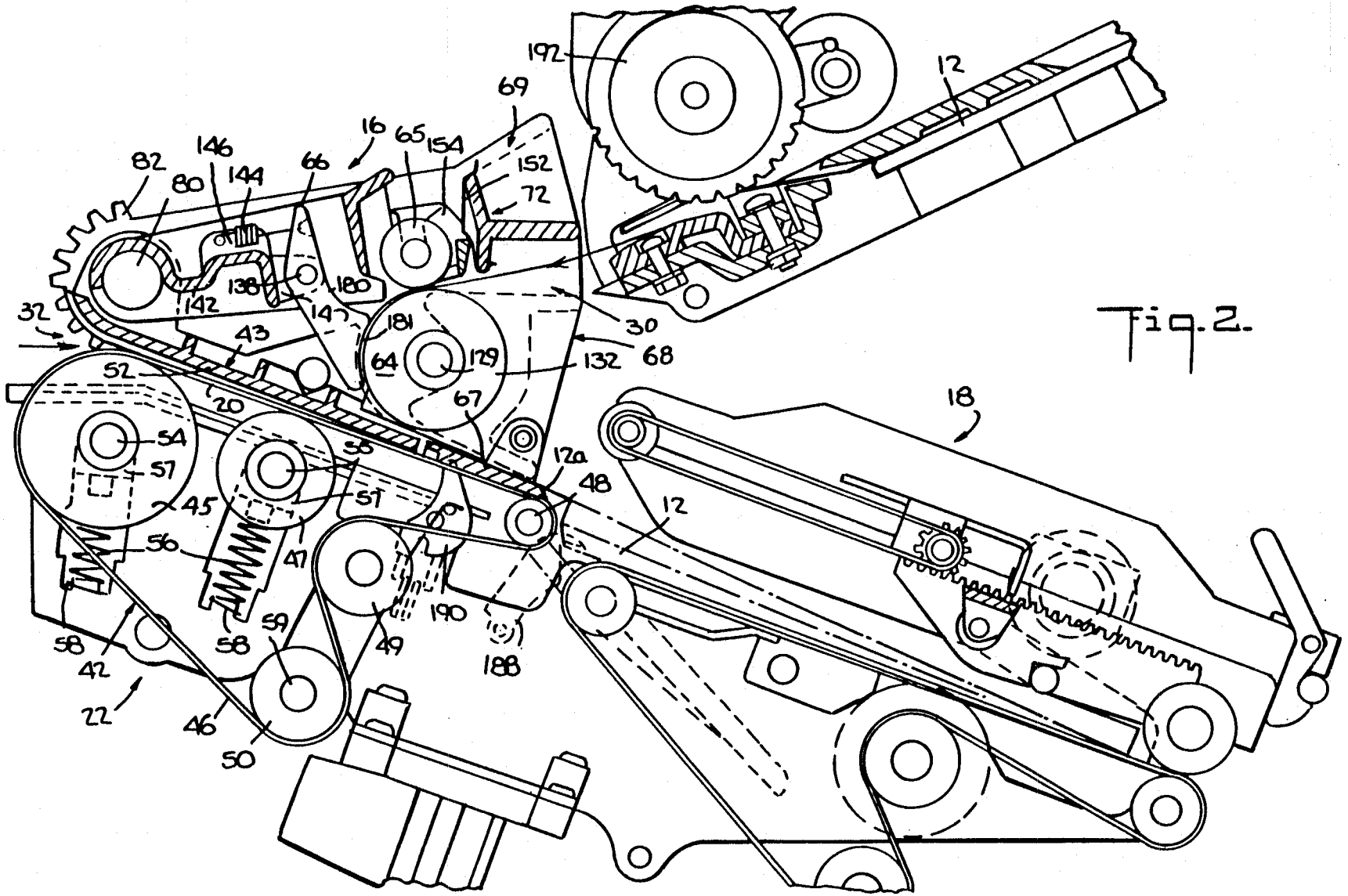
FIG. 2 is a section view of the apparatus of FIG. 1 taken along line 2—2 in FIG. 1.

Referring to FIGS. 1 and 2, apparatus 10 feeds envelopes 12 (not shown in FIG. 1) seriatim from an envelope feeder 14 into an envelope flap unfolding assembly or envelope flapper 16 (flap unfolding means) which flaps the envelope open and feeds the flapped envelope to a queuing station 18 (means for holding the envelope open) where the envelope is held open for insertion therein of folded documents 20 (not shown in FIG. 1). The folded documents 20 are fed to apparatus 10 from a document processing apparatus not shown in the drawings, entering apparatus 10 at the right in FIG. 1 and the left in FIG. 2. The folded documents 20 are received in apparatus 10 by an enclosure transporter 22 (means for moving the enclosure along the enclosure feed path) and fed to the queuing station 18 where they are inserted into the held-open envelope 12. The stuffed envelope is then discharged by the queuing station 18 onto a ramp 24 at the left of the apparatus as seen in FIG. 1 where the stuffed envelopes are collected for further processing.

Envelopes fed from envelope feeder 14 are moved by apparatus 10 through flap unfolding assembly 16 to queuing station 18 along an envelope flap unfolding path 30 (FIG. 2), and documents received by document transporter 22 are moved by apparatus 10 to queuing station 18 along a enclosure feed path 32. The invention is concerned with flapping the envelopes open and inserting enclosures therein while providing access to the flap unfolding path 30 and the enclosure feed path 32 so that jammed envelopes and enclosures may easily be removed. In accordance with the invention, apparatus 10 is constructed and the drive arranged so that parts thereof may be easily moved to substantially fully expose flap unfolding path 30 and enclosure feed path 32, as well as the upstream end of queuing station 18 to facilitate removal of jammed envelopes and enclosures.

Referring to FIG. 1, apparatus 10 includes a base frame 34 comprised of spaced frame sides 37 and 38 from which flap unfolding assembly 16, queuing station 18 and enclosure transporter 22 are supported. Envelope feeder 14 is supported from an upper frame 40 which in turn is supported by frame sides 37, 38. Referring to FIG. 2, enclosure transporter 22 comprises a first or lower assembly or portion 42 and a second or upper portion 43. Lower assembly 42 includes a pair of endless belts 46 (shown in FIG. 1; only one belt 46 is shown in FIG. 2), driven pulley 45 and pressure and idler pulleys 47-50. Upper portion 43 comprises a smooth stationary lower surface 52 disposed opposite endless belts 46. The shafts 54, 55 to which are mounted pulleys 45 and 47, respectively, are resiliently mounted to frame sides 37, 38 to urge belts 46 against lower surface 52 to engage enclosures therebetween. As shown schematically in FIG. 2, ends of springs 56 engage bearings 57 mounted to shafts 54, 55 and spring retainer seats 58 in base frame 34 to urge shafts 54 and 55 upwardly towards lower surface 52, and thereby resiliently urge belts 46 against lower surface 52. Shaft 59 on which pulley 50 is mounted, is driven clockwise (FIG. 2) to drive belts 46 clockwise and move enclosures engaged between belts 46 and lower surface 52 along enclosure feed path 32 to queuing station 18.

Figure 4:
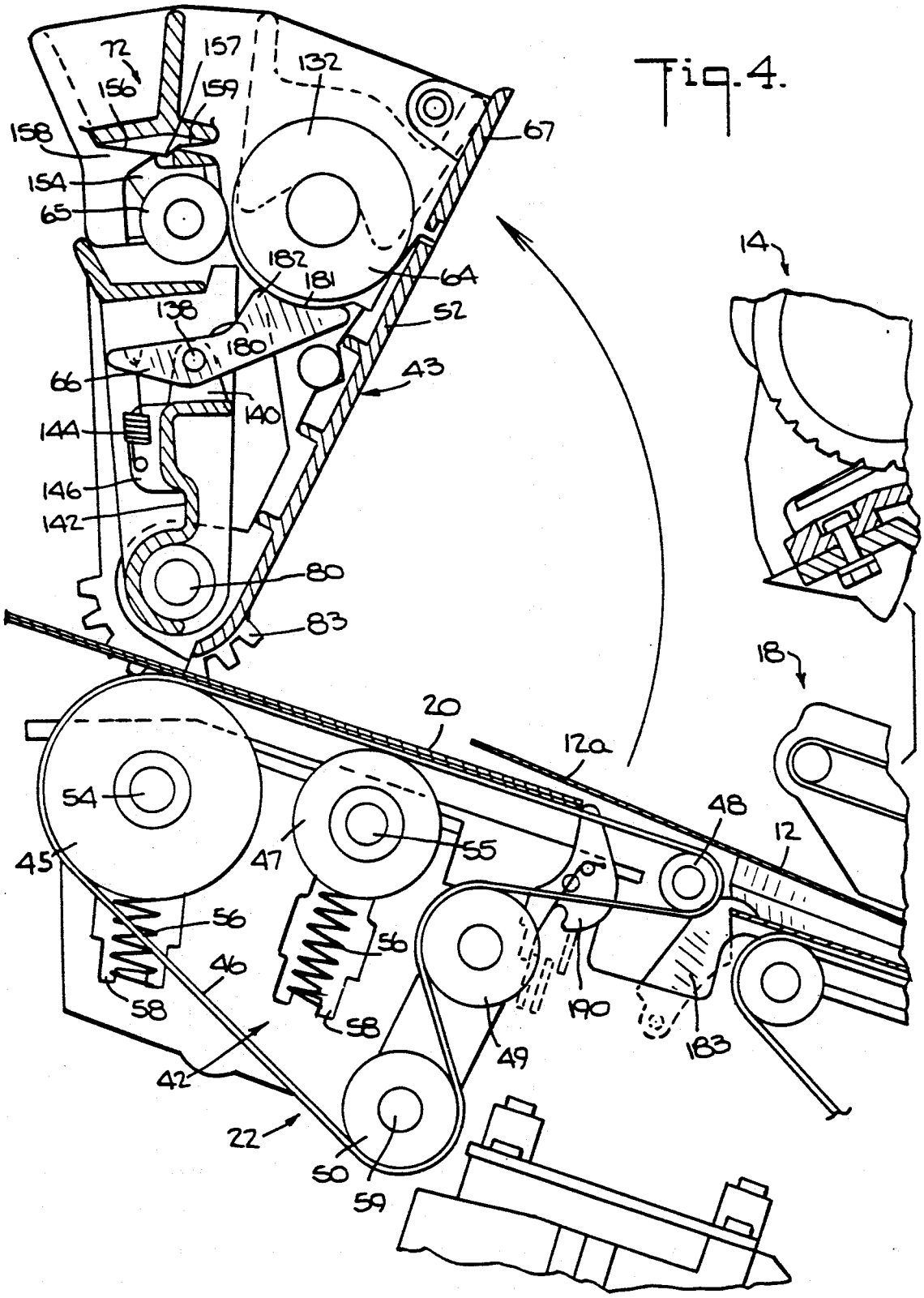
FIG. 4 is a section view similar to that of FIG. 2 of the apparatus of FIG. 1 but with the entire envelope unfolding assembly pivoted open to provide access to the document feed path and the upstream end of a queuing station.

Except for the resilient mounting of shafts 54 and 55 described above (and the rotation of the pulleys and belts), lower assembly 42 of enclosure transporter 22 is fixed with respect to base frame 34. However, the upper portion 43 of enclosure transporter 22 is mounted to flap unfolding assembly 16 which is pivotally mounted to base frame 34. As a result, flap unfolding assembly 16 including upper portion 43 of enclosure transporter 22 may be pivoted away from belts 46 as shown in FIG. 4. This exposes the entire enclosure feed path 32 up to the upstream end of queuing station 18 and provides an operator with jam-clearing access to the enclosure feed path 32. As described below in more detail, flap unfolding assembly 16 may be pivoted open by releasing a latching mechanism 62 (FIG. 4), and then simply grasping flap unfolding assembly 16 and pivoting it from the position shown in FIG. 2 to the position shown in FIG. 4. Thus, jam-clearing access to enclosure feed path 32 may be obtained easily and practically instantly.

Figure 5:
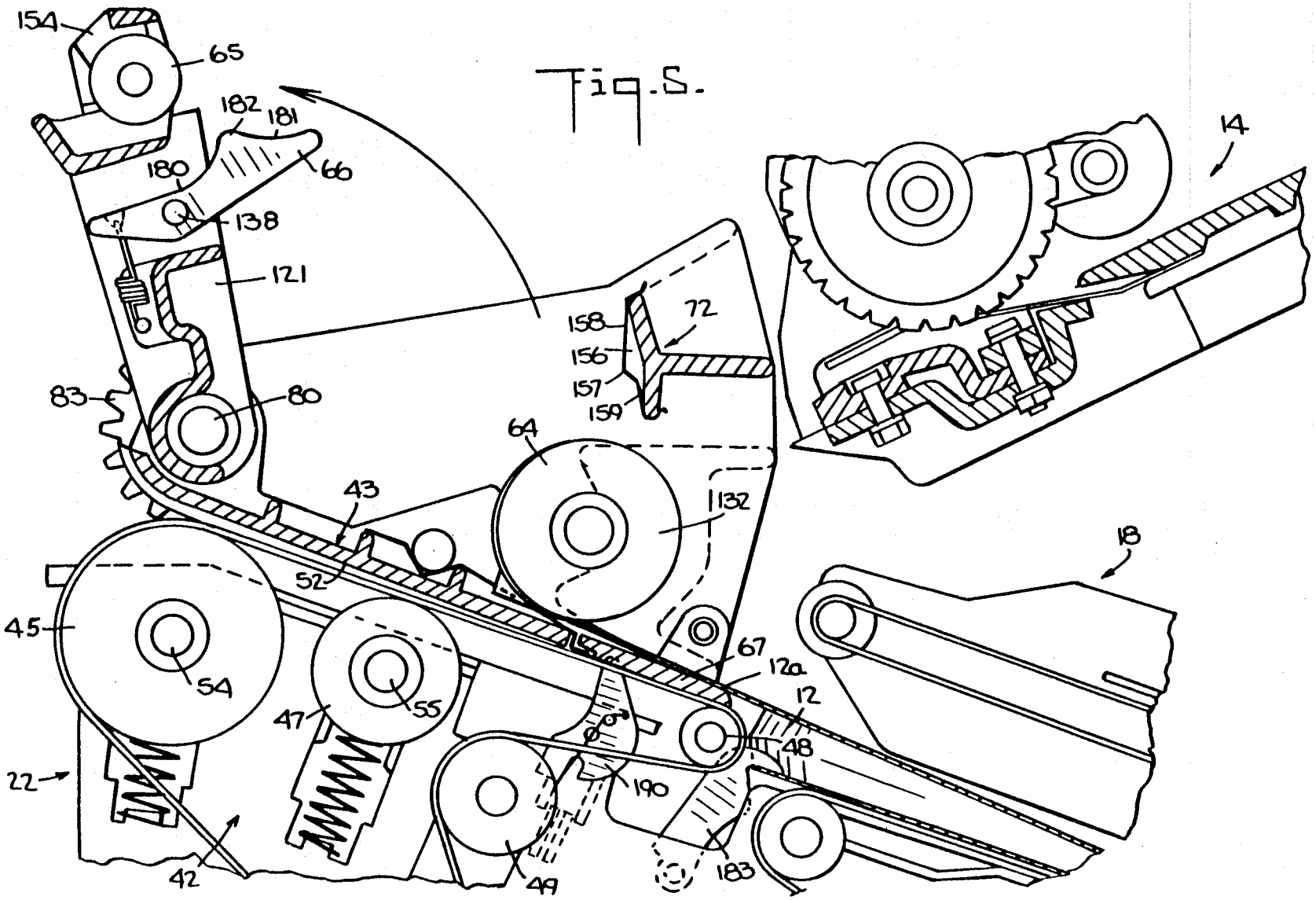
FIG. 5 is a section view similar to that of FIG. 2 of the apparatus of FIG. 1 but with part of the envelope unfolding assembly pivoted open to provide access to the envelope unfolding path.
Figure 6:
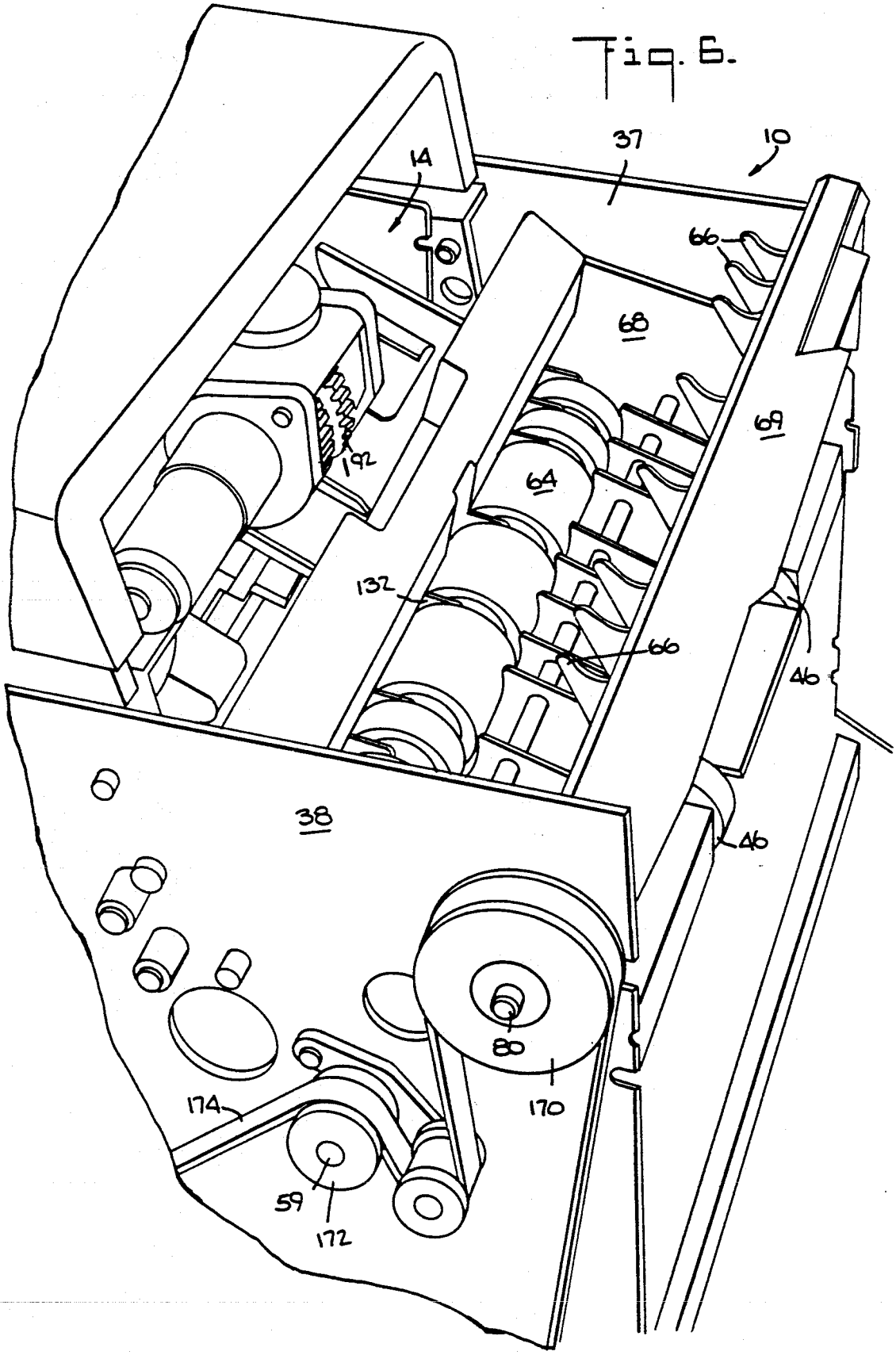
FIG. 6 is a top perspective view similar to that of FIG. of the apparatus of FIG. 1 but with part of the envelope unfolding assembly pivoted open as depicted in FIG. 5.

Referring to FIGS. 2 and 4, flap unfolding assembly 16 comprises, in addition to the upper portion 43 of enclosure transporter 22, all of the flap unfolding components including opposed rollers 64 and 65, fingers 66 and a flap holding portion 67. The flap unfolding path 30 in flap unfolding assembly 16 passes through the nip of first and second rollers 64 and 65, around second roller 65, above the downstream end of upper portion 43 of transporter 22, over flap holding portion 67 and to the upstream end of queuing station 18. In accordance with the invention, portions of flap unfolding assembly 16 are mounted on different frames 68, 69 of flap unfolding assembly 16 which are pivoted together so that flap unfolding assembly 16 may be opened, as depicted in FIGS. 5 and 6, to separate second roller 65 from first roller 64 and expose substantially the entire flap unfolding path 30 in flap unfolding assembly 16. As described below in more detail, first frame 69 may be pivoted away from second frame 68 by simply grasping it and pivoting it from the position shown in FIG. 2 to the position shown in FIG. 5 against a spring detent latching mechanism 72. Thus, jam-clearing access to flap unfolding path 30 may also be obtained easily and practically instantly.

According to the invention, jam-clearing access is provided to the enclosure feed path 32 as well as to the flap unfolding path 30. Further details of the flap unfolding assembly 16 and enclosure transporter 22 are described below. Envelope feeder 14 and queuing station 18 including a flap opening mechanism may be conventional and are therefore not described in detail herein.

Figure 3:
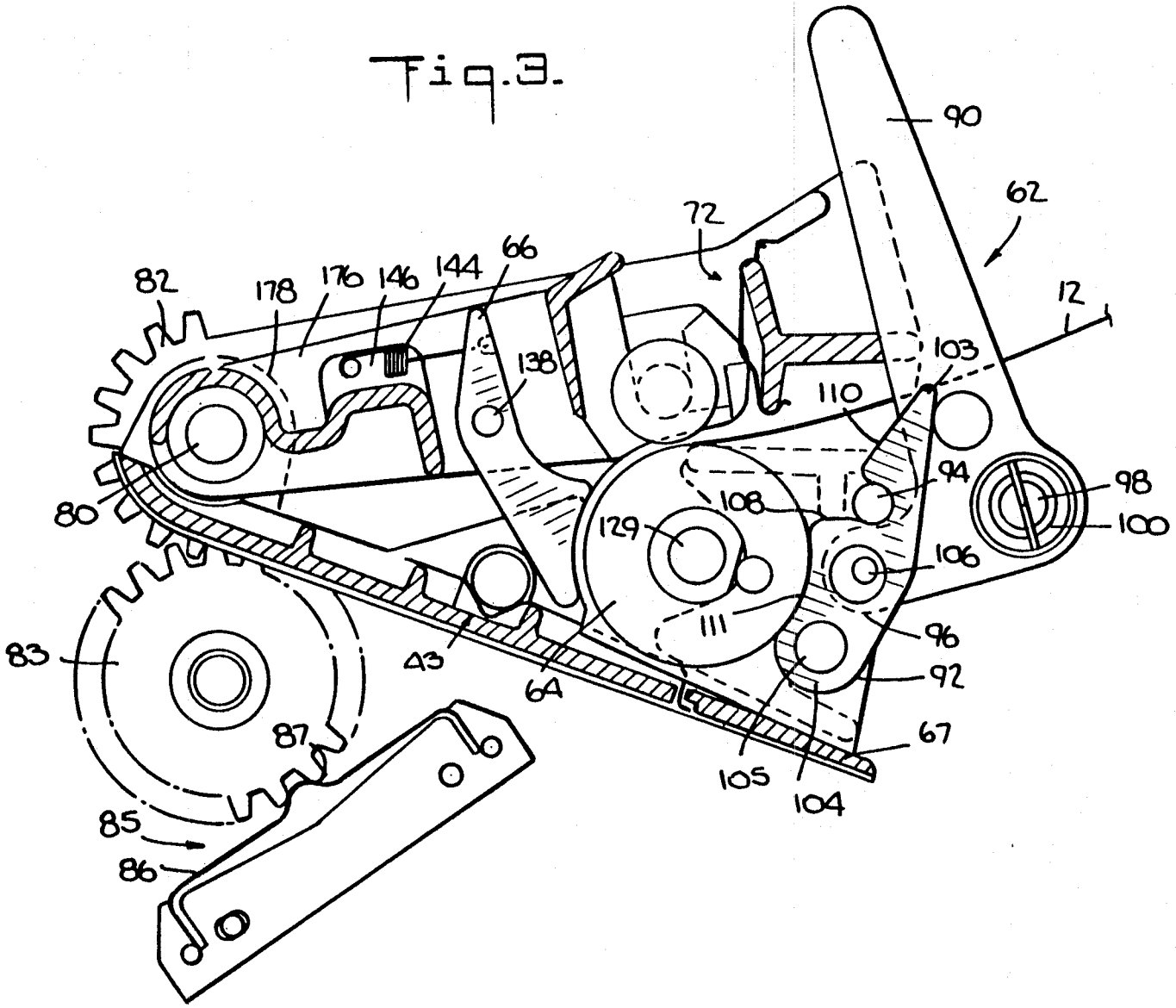
FIG. 3 is a section view of a latch mechanism for releasably holding the envelope unfolding assembly in its operating position.

Referring to FIG. 2, flap unfolding assembly 16 includes a shaft 80 that is rotatably mounted to frame sides 37 and 38. Frame 68 is mounted to bearings (not shown) on shaft 80 such that frame 68, and with it frame 69, i.e., the entire flap unfolding assembly 16, may be pivoted as described above and shown in FIG. 4. Fixed to frame 68 at one end thereof is a gear 82. As shown in FIG. 3, another gear 83 is rotatably supported from frame side 37 below and in mesh with gear 82. A spring detent 85 including a flexible band spring portion 86 and a detent 87 extending therefrom is disposed adjacent gear 83 such that the teeth of gear 83 engage the detent 87. Gears 82 and 83 in cooperation with spring detent 85 function as a torsion spring for frame 68 during pivoting thereof. A given force is required to flex spring portion 86 so that the detent 87 rides out of engagement between an adjacent pair of teeth and into engagement with a next pair of adjacent teeth. The spring force of spring detent 85 is selected so that frame 68 resists pivoting and will not free fall after it passes the top center of its pivot travel, and preferably will remain in a position it is pivoted to if near the top center.

Referring to FIG. 3, the latching mechanism 62 comprises a lever 90 pivotally mounted to frame side 37, a pawl 92 pivotally connected to lever 90 and to frame side 37, and a rod 94 fixed to frame 68 which is engaged by pawl 92. Lever 90 is rotatably connected near end 96 thereof to side frame 37 via a pivot rod 98 fixed to side frame 37. A spring 100 wound on pivot rod 98, engaged at opposed ends thereof with lever 90 and pivot rod 98, urges lever 90 in a clockwise direction. Pawl 92 is articulated intermediate its ends 103, 104 to end 96 of lever 90, and adjacent its end 104 to side frame 37 via pivot rods 106 and 105, respectively. A latching recess 108 is provided adjacent end 103 of pawl 92 for receiving rod 94 fixed to frame 68. FIG. 3 shows latching mechanism 62 in its latched position with lever 90 under action of spring 100 urging pawl 92 into latching engagement with rod 94.

Latching recess 108 includes an upper camming surface 110 and a lower camming surface 111. To unlatch latching mechanism 62, lever 90 is pivoted counterclockwise which pivots pawl 92 counterclockwise about pivot rod 106 so that lower camming surface 111 of recess 108 rides on rod 105 as recess 108 is moved out of engagement with rod 94. When frame 68 has been unlatched, spring 100 urges lever 90 and with it pawl 92 further clockwise from the positions depicted in FIG. 3. To latch latching mechanism 62, frame 68 is pivoted clockwise towards belts 46 of enclosure transporter 22 until rod 94 contacts the upper camming surface 110 of pawl 92. Continued pivoting of frame 68 pivots pawl 92 clockwise until rod 94 is engaged in recess 108. Part of the latching action of latching mechanism 62 derives from the resilient mounting of belts 46, i.e., as frame 68 is pivoted clockwise, it contacts belts 46 whose movement is resiliently resisted by the action of springs 56. Thus, after latching mechanism 62 latches, springs 56 urge frame 68 counterclockwise, which urges rod 94 into engagement with recess 108.

Referring to FIGS. 2, 5 and 6, frame 69 is pivotally connected to frame 68 so that frame 69 may be pivoted from the operating position depicted in FIG. 2 to the jam-clearing position depicted in FIGS. 5 and 6. Frame 69 includes a pair of spaced arms 120, which are pivotally connected at one end thereof to circular brackets 123, fixed to frame 68 extending about shaft 18.

Figure 7:
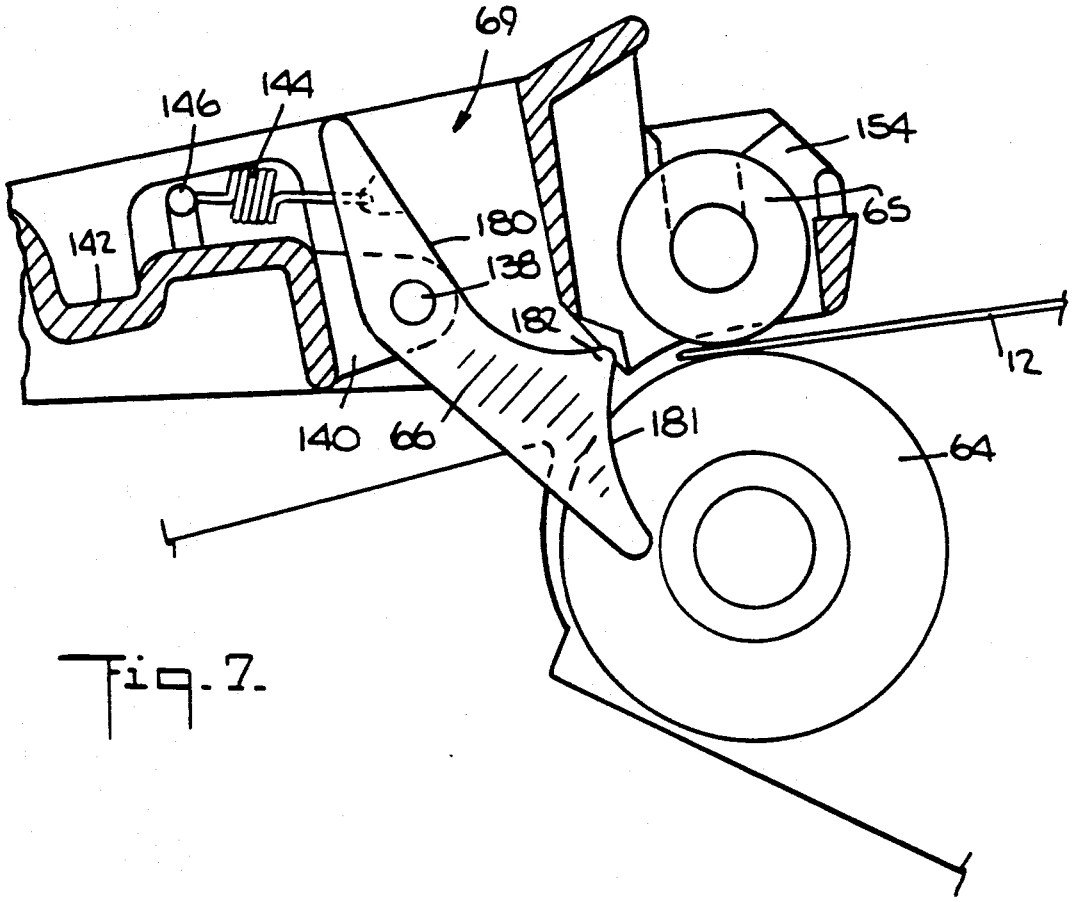
FIGS. 7-10 are section views of the envelope unfolding assembly of the apparatus of FIG. 1 illustrating the sequence for flapping an envelope.

Referring to FIG. 2, roller 64 of flap unfolding assembly 16 is fixed to a shaft 129 which is rotatably supported by frame 68. As shown in FIG. 6, roller 64 has spaced circumferential recesses or grooves 131 therein. Semi-circular fingers 132 fixed to frame 68 project into one side of recesses 131 (the upstream side relative to the flap unfolding path 32). As shown in FIGS. 2, 3 and 7, other fingers 66 are disposed in recesses 131 on the downstream side of roller 64. Fingers 66 are connected together at their upper ends (which connection is not shown in the drawings) and are fixed to a rod 138 to pivot together with rod 138 about the axis of rod 138. Rod 138 is pivotally connected to brackets 140 connected to a sheet-like bracket 142 fixed to frame 69 adjacent shaft 80. Springs 144 are connected at opposite ends thereof to anchors 146 on sheet-like bracket 142 and to the member (not shown) interconnecting fingers 66 to urge fingers 66 clockwise into engagement with recesses 131 in roller 64. Sheet-like bracket 142 and fingers 66 are carried by and pivot with frame 69, as shown in FIG. 5.

Referring to FIGS. 2 and 4, frames 68 and 69 are latched together by a latching mechanism 72 comprising a band spring detent 152 fixed to frame 68 and a recess 154 in frame 69. Band spring detent 152 includes a band spring portion 156 (FIG. 4) having a projection 157 and upper and lower camming surfaces 158 and 159. In the closed position of latching mechanism 72 depicted in FIG. 2, projection 157 is received in recess 154. To unlatch frames 68 and 69, frame 69 is grasped and pivoted counterclockwise (FIG. 2). The force applied causes the lower edge of recess 154 to ride along and cam lower camming surface 159 inwardly to flex band spring portion 156 inwardly so that projection 157 may ride out of recess 154. To latch latching mechanism 150, frame 69 is pivoted clockwise until upper camming surface 158 contacts the lower edge of recess 154. Continued pivoting of frame 69 cams camming surface 158 inwardly to flex the band spring portion 156 until projection 157 enters recess 154. Thus, the spring action of the band spring portion 156 retains latching mechanism 72 latched, and unlatching and re-latching is accomplished simply by grasping frame 69 and applying sufficient pivoting force to it to over come the force of the band spring portion 156.

Referring to FIGS. 1 and 6, pulleys 170, 172 are fixed to ends of shafts 80 and 59, respectively, on frame side 38 to drive those shafts by means of an endless belt 174 coupled via idler pulleys and pulleys fixed to shafts of queuing station 18 to a drive pulley connected to a drive motor not shown. Rotation of shaft 59 by pulley 172 drives endless belts 46 of the lower assembly 42 of enclosure transporter 22. Rotation of shaft 80 drives roller 64 as follows. Referring to FIG. 3, roller 64 is driven by means of a pair of endless belts 176 (only one of which is shown) coupled by pulleys to shaft 80. Specifically, belts 176 pass around pulleys 178 (only one of which is shown) fixed to shaft 80 and pulleys 180 (only one of which is shown) fixed to shaft 129. Thus, a single drive source via drive belt 174 may provide the drive for envelope flap unfolding assembly 16, enclosure transporter 22 and queuing station 18. Moreover, by driving shaft 80 and by driving roller 64 via belts carried within flap unfolding assembly 16, it is possible to pivot the entire flap unfolding assembly 16. This arrangement also makes it possible to pivot frame 69 relative to frame 68 since shaft 80, belts 176 and roller 64 are all mounted to frame 68.

FIGS. 7–10 illustrate the sequence for flapping an envelope. Each finger 66 includes upper and lower oppositely curved edges 180, 181 which form a projection 182 therebetween. The lower portion of lower edge 181 rests in a circumferential recess 131 with projection 182 disposed beyond the circumference of roller 64 as depicted in FIG. 7. Envelopes 12 are fed to flap unfolding assembly 16 with the flap side up and the flap at the upstream edge of the envelope, i.e., the edge of an envelope 12 opposite the flap edge enters the nip of rollers 64 and 65 first as shown in FIG. 7.

Figure 8:
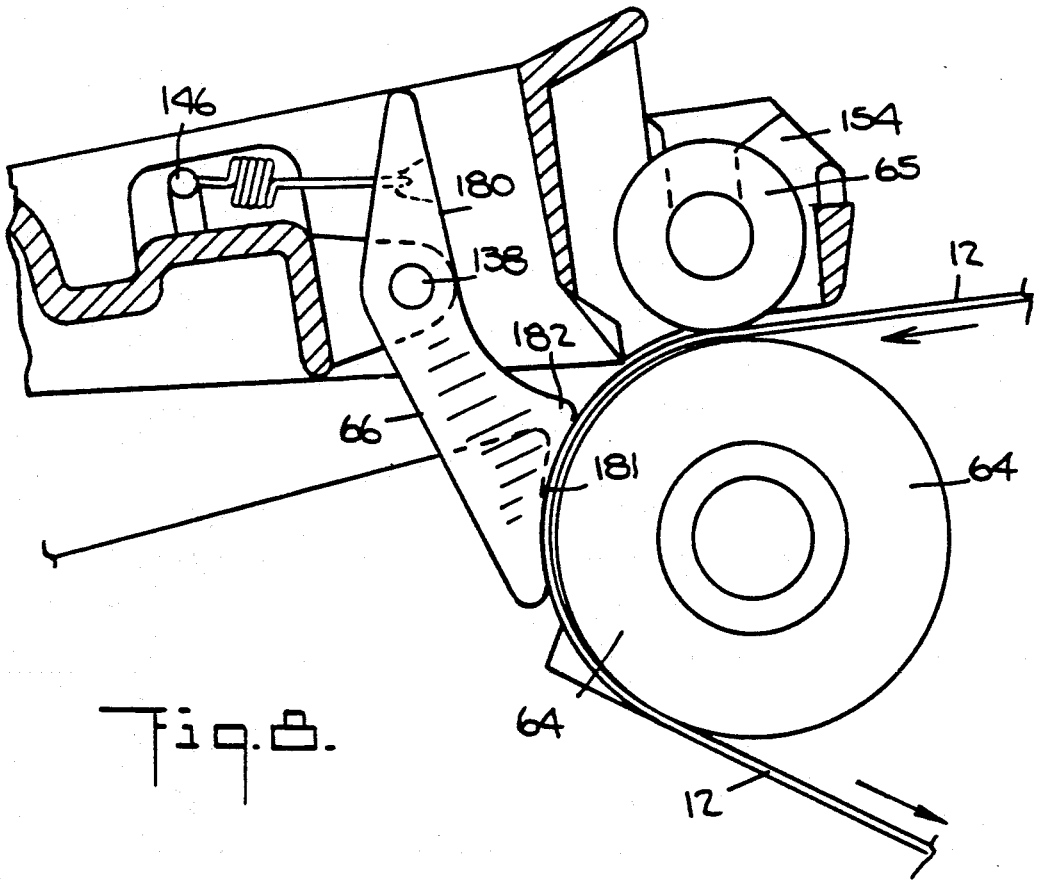
Figure 9:
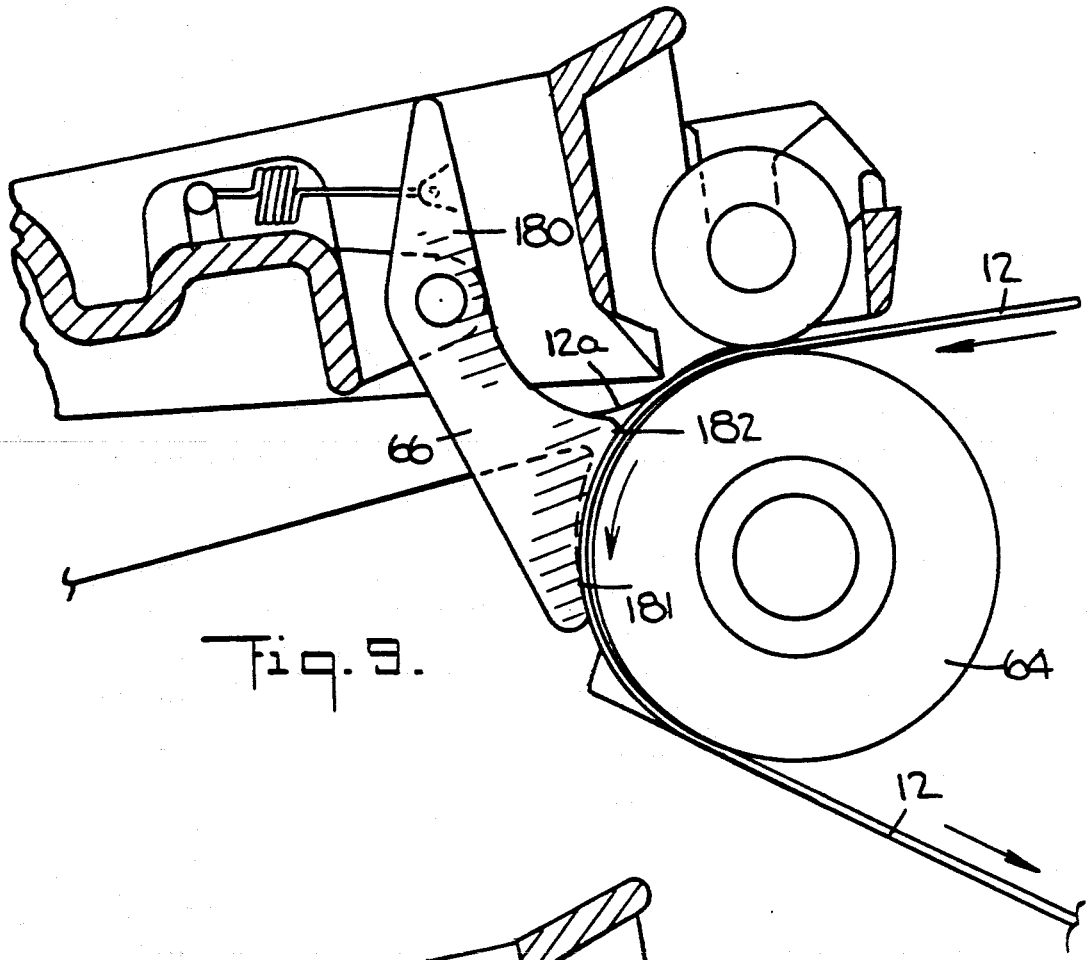
Figure 10:
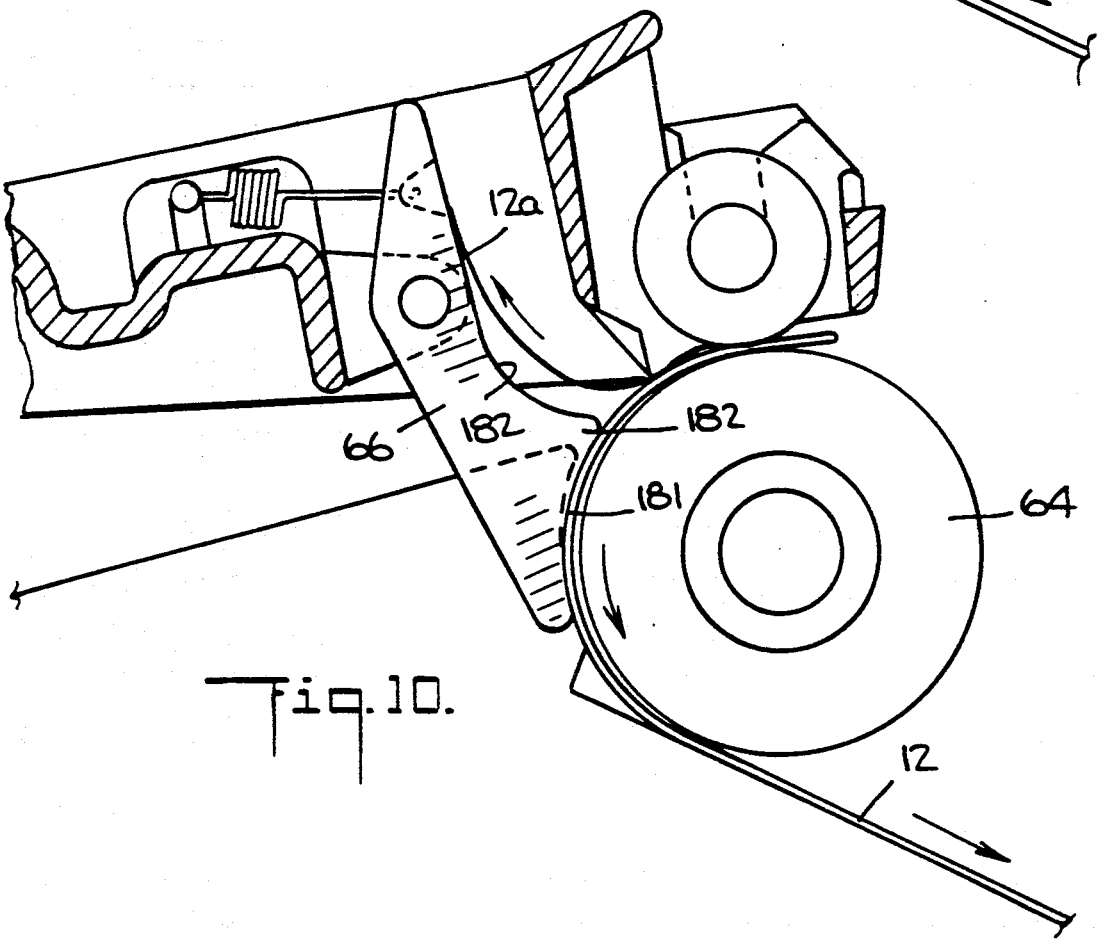

Rotation of roller 64 winds the envelope around roller 64 until the downstream edge of the envelope contacts the projections 182 of fingers 66 and pivots the fingers to the position depicted in FIG. 8 in which the lower edges 181 of fingers 66 ride on the envelope. FIG. 3 shows the positions of fingers 66 in solid and broken lines. Continued rotation of roller 64 causes the downstream edge of envelope 12 to pass over flap holding portion 67 and enter queuing station 18. Stationary fingers 132 (not shown in FIGS. 7–10) projecting into recesses 131 prevent the downstream edge of envelope 12 from winding completely around roller 64. At the same time, envelope flap **12*a* rides over projection 182 onto upper finger edges 180, as depicted in FIG. 9. This starts flapping or opening of the envelope flap 12*a*. As roller 64 is rotated still further, flap 12*a* rides further on upper finger edges 180 as depicted in FIG. 10 until the flap 12*a* is fully opened (not shown in the sequence of FIGS. 7–10), after which the flap 12*a* of envelope 12 continues to be advanced around roller 64 while the downstream edge of envelope 12 enters queuing station 18. Finally, movement of envelope 12 is stopped with the flap 12*a* resting on the upper surface of flap holding portion 67 mounted to frame 68, as shown in FIG. 2. At that time, a pair of spaced claws 188 (only one of which is shown) is pivoted into the opening of flapped envelope 12 to open the envelope sufficiently to receive enclosures advanced along enclosure feed path 32 by enclosure transporter 22. After the enclosures have been inserted into the held-open envelope 12, the envelope is discharged from apparatus 10 onto ramp 24 by the queuing station 18**.

Timing for feeding envelopes 12 into flap unfolding assembly 16, feeding enclosures into enclosure transporter 22, pivoting claw 188 and discharging a stuffed envelope 12 from queuing station 18 is derived from the following sensors: a sensor (not shown) in the envelope feeder 14 which senses passage therefrom of the downstream edge of an envelope; a sensor (not shown) in queuing station 18 senses receipt of an envelope to be stuffed; a sensor or sensors (not shown) sense opening of an envelope by claws 188 and positioning of an opened flap on flap holding portion 67 in the flap unfolding path 30; and a sensor 190 in enclosure transporter senses passage therepast of enclosures being inserted into an envelope 12. Those sensors are coupled to a system controller (not shown) which controls the drive for rollers 192 in envelope feeder 14, feeding of enclosures to enclosure transporter 22, pivoting of claws 188 and discharge of stuffed envelopes by queuing station 18. Roller 64 in flap unfolding assembly 16 and belts 46 in enclosure transporter 22 are driven continuously. Thus, control is achieved by properly timing feeding of envelopes, the dwell time of a held-open envelope in queuing station 18, feeding of enclosures into enclosure transporter 22, and discharge of stuffed envelopes, as monitored by the sensor described above. A system controller and sensors to achieve the foregoing functions and timing are within the skill of those in the relevant art.

Certain changes and modifications of the embodiments of the invention herein disclosed will be readily apparent to those of skill in the art. It is the applicant's intention to cover by the claims all those changes and modifications which could be made to the embodiments of the invention herein chosen for the purposes of disclosure which do not depart from the spirit and scope of the invention.

What is claimed is:

1. Apparatus for inserting enclosures into envelopes, comprising:

flap unfolding means for unfolding the flap of envelope and moving it along a flap unfolding path to an enclosure inserting location in said apparatus means for holding the flap-unfolded envelope open at said enclosure inserting location;

means for moving an enclosure along an enclosure feed path to the held-open envelope and inserting the enclosure into the held-open envelope;

in a first operating position thereof said flap unfolding means substantially blocking access to said enclosure feed path; and means for moving only said flap unfolding means away from said first operating position thereof to permit access to said enclosure feed path.

2. The apparatus of claim 1 wherein said enclosure inserting means comprises first and second opposed surfaces defining said enclosure feed path and between which an enclosure is engaged and moved, at least one of said surfaces being movable in the direction of said enclosure feed path, said apparatus comprising a mounting structure to which said flap unfolding means and said first surface are mounted, a base frame, means movably mounting said second surface to said base frame, said mounting structure in said first operating position of said flap unfolding means positioning said first and second surfaces adjacent each, other, and wherein said means for moving said flap unfolding means comprises means pivotally connecting said mounting structure to said base frame for movement of said mounting structure from said first position in which said first and second surfaces are adjacent each other to said other position in which said first surface is pivoted away from and exposing said second surface, thereby exposing said enclosure feed path.

3. The apparatus of claim 2 wherein said second surface is defined by at least one endless belt and said means for movably mounting said second surface to said base frame comprises at least one pulley mounted to a shaft, said shaft being mounted to said base frame.

4. The apparatus of claim 3 wherein said first surface is defined by a smooth surface having a contour conforming to said enclosure feed path which said smooth surface in part defines, said smooth surface being fixed to said mounting structure.

5. The apparatus of claim 1 wherein said flap unfolding means comprises means for engaging the flap of an envelope moved therepast and a movable surface which moves the envelope along said flap unfolding path past the engaging means, said mounting structure comprising a first frame to which said engaging means is mounted, a second frame to which said moving surface of said flap unfolding means is mounted and means pivotally connecting said first and second frames together for movement of said first frame from a first operating position in which said engaging means is adjacent said moving surface of said flap unfolding means and another position in which said engaging means is pivoted away from and exposing said moving surface of said flap unfolding means, and thereby said flap unfolding path.

6. The apparatus of claim 5 wherein said moving surface of said flap unfolding means comprises a first roller rotatably mounted to said second frame and said engaging means comprises a plurality of fingers each having a projection thereon, said finger being pivotally mounted to said first frame such that the downstream edge of an envelope moving in said flap unfolding path engages said projections and pivots said fingers, said projections in the pivoted position of said fingers engaging the flap of said envelope and unfolding it as said roller continues movement of said envelope along said flap unfolding path, said roller being substantially exposed in said other position of said first frame.

7. The apparatus of claim 6 wherein said flap unfolding means comprises a second roller mounted to said first frame, said first and second rollers in said first position of said first frame forming a nip to which an envelope whose flap is to be unfolded is fed, said second roller being moved away from and exposing said first roller in said other position of said first mounting frame.

8. Apparatus for inserting enclosures into envelopes, comprising:

flap unfolding means for unfolding the flap of an envelope and moving it along a flap unfolding path to an enclosure inserting location in said apparatus, said flap unfolding means comprising means for engaging the flap of an envelope moved therepast and a movable surface which moves the envelope along said flap unfolding path past said engaging means;

means for holding the flap-unfolded envelope open at said enclosure inserting location;

means for moving an enclosure along an enclosure feed path to the held-open envelope and inserting the enclosure into the held-open envelope;

in a first operating position thereof said flap unfolding means substantially blocking access to said flap unfolding path and said enclosure feed path;

means for moving one of said flap engaging means and said movable surface away from each other to permit access to said flap unfolding path; and means for moving only said flap unfolding means away from said first operating position thereof to permit access to said enclosure feed path.

9. The apparatus of claim 8 wherein said enclosure inserting means comprises first and second opposed surfaces defining said enclosure feed path and between which an enclosure is engaged and moved, at least one of said surfaces being movable in the direction of said enclosure feed path, said apparatus comprising a mounting structure to which said flap unfolding means and said first surface are mounted, a base frame, and means movably mounting said second surface to said base frame, said mounting structure in said first operating position of said flap unfolding means positioning said first and second surfaces adjacent each other, and wherein said means for moving said flap unfolding means comprises means pivotally connecting said mounting structure to said base frame for movement of said mounting structure from said first position in which said first and second surfaces are adjacent each other to said other position in which said first surface is pivoted away from and exposing said second surface, thereby exposing said enclosure feed path.

10. The apparatus of claim 9 wherein said mounting structure comprising a first frame to which said engaging means is mounted, a second frame to which said moving surface of said flap unfolding means is mounted and means pivotally connecting said first and second frames together for movement of said first frame from a first operating position in which said engaging means is adjacent said moving surface of said flap unfolding means and another position in which said engaging means is pivoted away from and exposing said moving surface of said flap unfolding means, and thereby said flap unfolding path.

11. Apparatus for inserting enclosures into envelopes, comprising:

an envelope feeder;

an envelope flap unfolder for receiving an envelope from said envelope feeder and unfolding the flap of said envelope;

a queuing station for receiving from said envelope flap unfolder an envelope with its flap unfolded and holding the flap-unfolded envelope open to receive an enclosure;

an enclosure transporter for feeding an enclosure along an enclosure feed path into the flap unfolded envelope held at the queuing station;

in a first operating position thereof said envelope flap unfolder substantially blocking access to said enclosure feed path;

means for moving only said envelope flap unfolder from a first operating position to a second position thereby providing access to said enclosure feed path.

12. The apparatus of claim 11 wherein said envelope flap unfolder comprises means for engaging the flap of an envelope moved therepast and a movable surface which moves the envelope along a flap unfolding path past said engaging means, and first and second frames pivotally mounted together, said engaging means being mounted to one of said frames and said movable surface being mounted to the other of said frames, whereby said frames may be pivoted apart to provide access to said flap unfolding path, said moving means comprising means pivotally mounting said first frame with respect to said enclosure transporting means such that said first and second frames may be pivoted together away from said first position.

13. The apparatus of claim 12 wherein said enclosure transporter comprises first and second opposed surfaces defining said enclosure feed path and between which an enclosure is engaged and moved, said second surface being movable in the direction of said enclosure feed path, said first surface being mounted to said first frame, said apparatus comprising a base frame, means movably mounting said second surface to said base frame, said moving means pivotally mounting said first frame to said base frame, whereby pivoting of said first frame away from said enclosure transporter exposes said second surface, thereby providing access to said enclosure feed path.

14. The apparatus of claim 13 wherein said second surface is defined by at least one endless belt and said means for movably mounting said second surface to said base frame comprises at least one pulley mounted to a shaft which is mounted to said base frame.

15. The apparatus of claim 14 wherein said first surface is defined by a smooth surface having a contour conforming to said enclosure feed path which said smooth surface in part defines, said smooth surface being fixed to said first frame.

16. The apparatus of claim 11 wherein a portion of said queuing station is disposed adjacent said envelope flap unfolder and movement of said envelope flap unfolder away from said first position provides access to said portion of said queuing station.

* * * * *